US007475572B2

(12) United States Patent
Lappoehn et al.

(10) Patent No.: US 7,475,572 B2
(45) Date of Patent: Jan. 13, 2009

(54) WASHING MACHINE WITH A DEVICE FOR THE SECURITY DURING TRANSPORT

(75) Inventors: Andreas Lappoehn, Uhingen (DE); Walter Dunst, Aichtal (DE)

(73) Assignee: Whirlpool Corporation, Benton Harbor, MI (US)

( * ) Notice: Subject to any disclaimer, the term of this patent is extended or adjusted under 35 U.S.C. 154(b) by 663 days.

(21) Appl. No.: 10/853,946

(22) Filed: May 26, 2004

(65) Prior Publication Data

US 2004/0237602 A1 Dec. 2, 2004

(30) Foreign Application Priority Data

May 27, 2003 (EP) ..... 03011185

(51) Int. Cl.
*D06F 37/00* (2006.01)

(52) U.S. Cl. ..... 68/3 R; 206/320

(58) Field of Classification Search ..... 68/3, 68/212, 235 R, 206, 230; 6/230; 206/320; 248/500

See application file for complete search history.

(56) References Cited

U.S. PATENT DOCUMENTS 4,624,117 A * 11/1986 Ory et al. ..... 68/3 R
4,837,559 A * 6/1989 Green, Sr. ..... 340/573.1
6,089,053 A * 7/2000 Colombera ..... 68/23.1
7,269,980 B2 * 9/2007 Kim et al. ..... 68/3 R
2004/0037640 A1 * 2/2004 Kim et al. ..... 403/408.1

FOREIGN PATENT DOCUMENTS

| | | | |
|---|---|---|---|
| DE | 2340660 A | * | 3/1974 |
| DE | 2635976 A | * | 5/1977 |
| DE | 7911823 | | 7/1979 |
| DE | 4428197 | * | 2/1996 |
| DE | 29511249 U1 | * | 11/1996 |
| DE | 19629884 | | 1/1998 |
| DE | 196 51 292 A1 | * | 6/1998 |
| DE | 29820224 U | * | 2/2000 |
| WO | WO0204458 A1 | * | 6/2002 |

* cited by examiner

*Primary Examiner*—Joseph L Perrin
(74) *Attorney, Agent, or Firm*—Clifton Green; Michael D. Lafrenz

(57) ABSTRACT

A washing machine has a power cable, a structural frame, a tub supported by the frame and a damping system interposed between the tub and the frame. An immobilizing rod interposed between the tub and the frame in order to prevent the tub from moving during the transport of the machine. The immobilizing or security rod includes a hook portion for engaging the power cable in order to prevent the user from connecting the power cable to a power source before the immobilizing rod is removed.

6 Claims, 2 Drawing Sheets

WASHING MACHINE WITH A DEVICE FOR THE SECURITY DURING TRANSPORT

BACKGROUND OF THE INVENTION

1. Field of the Invention

The present invention relates to a washing machine having a power cable, a structural frame, a tub supported by the frame, damping means interposed between the tub and the frame and immobilizing means interposed between the tub and the frame in order to prevent the tub from moving during the transport of the machine.

2. Description of the Related Art

Most washing machines have a transport immobilizing system that prevents the wash unit, particularly the tub and components connected thereto, from contacting the cabinet during transport. This immobilizing system of the wash unit must be removed at the place of installation by the end customer or by the installer so that the washing machine can function properly.

Despite the washing machine user manual prompting the user to remove the immobilizing system before using the machine, it can happen that the user does not read the manual before switching on the machine as it is shipped. Operating the machine as is presents the risk of damaging the machine and also furniture placed nearby.

Therefore there exists a need to force the customer to first remove the immobilizing system before he can put the washing machine into operation.

SUMMARY OF THE INVENTION

According to the invention, the main power cable of the washing machine is fixed to the transport immobilizing bolts of the wash unit inside of the cabinet of the washing machine. The end customer has first to remove the transport fixing bolts from the appliance in order to make the power cord free. Without removing the transport bolts the customer does not get the power cable out of the appliance and therefore cannot operate the appliance.

The present invention fixes the power cable properly and releases the cable automatically during the moment of removal of the transport fixing bolts from the appliance. No cable fixing parts are left at the power cable or inside of the washing machine because all cable fixing elements are fixed to the transport bolts and are removed together with them.

In one aspect, the present invention relates to a washing machine having a frame and a tub supported by the frame through a damping system interposed between the tub and the frame. An immobilizing rod is interposed between the tub and the frame. The immobilizing rod includes a projection for restraining the washing machine power cord. The washing machine can additionally include a second immobilizing rod interposed between the tub and the frame, and which also includes a projection for restraining the power cord. Preferably, the immobilizing rod includes a longitudinal hole for the mounting of transport bolt between the frame and the tub.

BRIEF DESCRIPTION OF THE DRAWINGS

Other advantages and features of a washing machine according to the invention will be clear from the following description with reference to the appended drawings in which.

DETAILED DESCRIPTION

Figure 1:
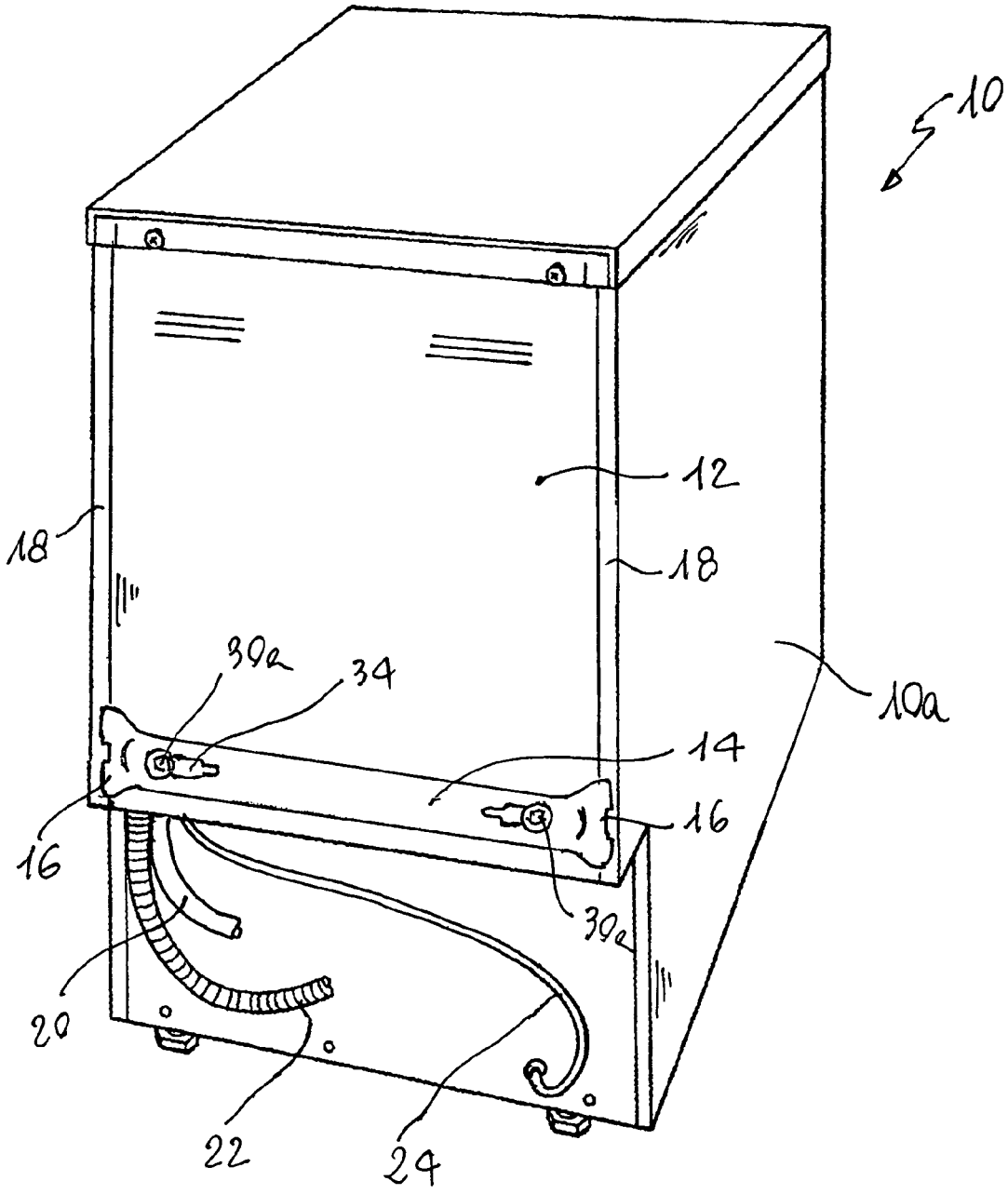
FIG. 1 is a perspective rear view of a washing machine according to the invention.

With reference to the drawings, with 10 it is shown a washing machine having a sheet metal frame 10*a*, a rear removable panel 12 and a reinforcing cross beam 14 fixed in 16 to two bent edges 18 of the frame 10*a*. In the bottom portion of the rear wall of the machine 10 an inlet flexible pipe 20 and an outlet flexible pipe 22 (only partially shown) are placed, as well as a main power cable or cord 24.

Figure 2:
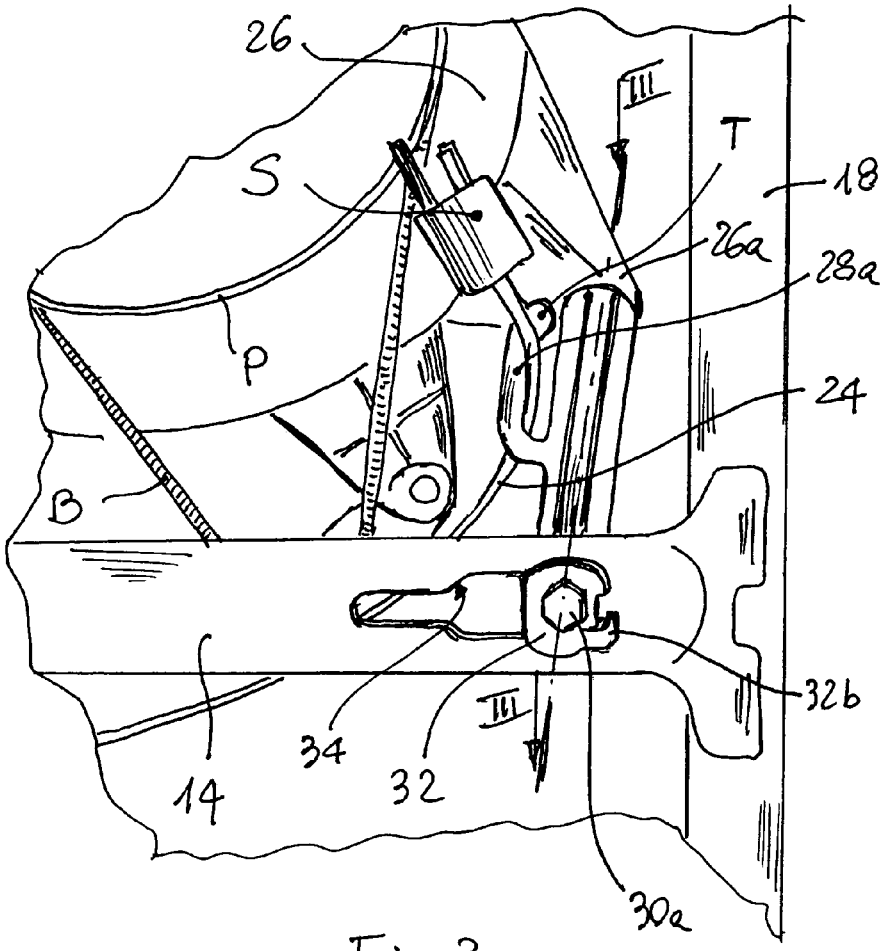
FIG. 2 is an enlarged view of a portion of the machine of FIG. 1 in which the rear panel of the machine is removed.

Inside the frame 10*a*, it is placed a tub 26 (FIG. 2) in which a drum (not shown) is rotatably mounted and it is driven by a belt B mounted on a first pulley of an electric motor (not shown) fixed to the tub and on a second pulley P fixed to the drum.

As it is well known, the tub is elastically suspended within the frame 10*a* by means of springs, damping cylinders or the like. In order to immobilize the tub 26 during transport, two plastic rods 28 are interposed between the tub 26 and the cross beam 14, each rod 28 having a longitudinal hole in which a bolt 30 is mounted. Such bolt has a head portion 30*a* which cooperates with the cross beam 14 with the interposition of a metal washer 32, and a screwed portion 30*b* which cooperates with a corresponding portion 26*a* of the tub.

Figure 3:
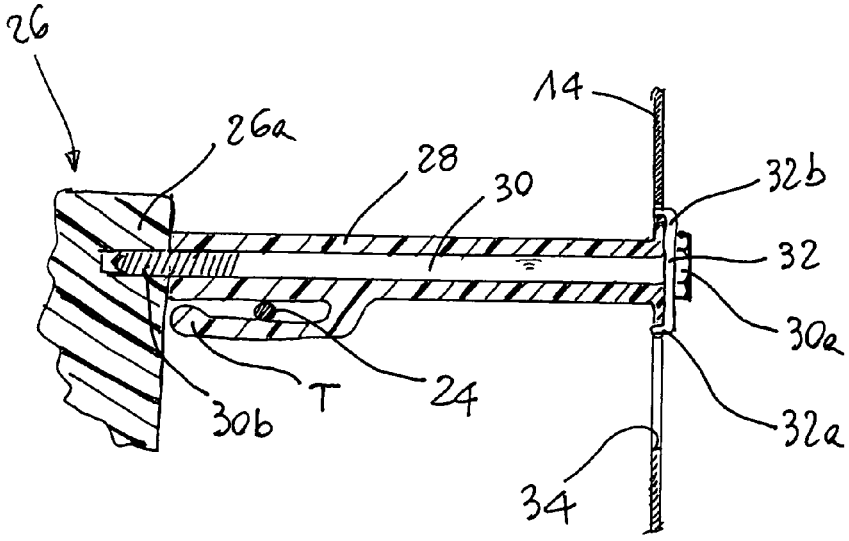
FIG. 3 is a cross section along line III-III of FIG. 2.

According to the invention, at least one of the rods 28 is provided with a hook-shaped elastic portion 28*a* parallel to the axis of the rod. Such portion 28*a* has a tip T which, in the configuration shown in FIGS. 2 and 3 (when the rod is installed), is adjacent or abutting the tub 26. In the hook-shaped elastic portion 28*a* it is lodged the power cable 24. It is clear (particularly from FIG. 2) that if the user tries to pull out the cable 24 from the bottom rear portion of the machine, the plug S connected to the cable 24 is prevented from passing through the portion 28, therefore the user has to unscrew the bolt 30 in order to remove the plastic rod 28. After having unscrewed the bolt 30, the user has only to shift laterally the assembly bolt 30 and rod 28 and to pull it out from an enlarged slot 34 provided in the cross beam 14. In this withdrawal movement the elastic hook-shaped portion 28*a* of the rod 28 disengages from the cable 24 which can then be pulled out for a certain length up to when the plug S comes into engagement with the second rod 28 (not shown) on the left portion of the rear panel of the washing machine. The user has then to remove also this second rod 28 before being able to free the plug S and to insert it in a socket of the main. Of course the user can invert the order of removal of the two rods, the result being the same, i.e. only when both rods 28 are removed the user can electrically connect the washing machine 10 to the main.

The metal washer 32 has two hooks portions. The first hook portion 32*a* has a thick end 32*a* which is fixed to a corresponding slot of an enlarged end portion 28*b* of the plastic rod 28. The second hook portion 32*b* has a sharp tip which is standing off the rod 28 and is lodged into a corresponding opening of the cross beam 14 for preventing the rod 28 from moving laterally on the metal cross beam 24 during transport (in case of handling shocks).

It is clear that the use of a two rods 28, each having a hook-shaped portion 28*a*, is preferred in order to be sure that both fixing rods are removed before switching-on the machine. Of course the use of only one rod with a hook-shaped portion is within the scope of the present invention, and in certain washing machines it may be even not necessary to use two fixing rods as well.

The shape of the rod 28 and of the hook-shaped portion thereof is given only as an example, other shapes reaching the same purpose being within the scope of the invention.

Even if in the example shown in the drawings a reinforcing cross beam 14 is used (such cross beam cooperating with the fixing rods 28), the technical solution according to the invention can work also without any cross beam element, since the shaped slots 34 for the transport fixing bolts 30 may be provided in the rear panel 12 as well. In this case such rear panel will have thickness sufficient to withstand the transport shocks without deformation.

Instead of a single rear cross beam 14, two or more cross beams can be used as well, each of them cooperating or not with one or more fixing rods 28.

The present invention has been described above with reference to specific embodiments and to the accompanying drawings. It is nevertheless understood that the teachings of this specification can be applied also for other cases without departing from the scope of the invention as defined in the appended claims.

We claim:

1. A washing machine comprising:

a frame defining an interior and having a frame aperture extending from an exterior of the frame to the interior;

a tub supported within the interior and having a screw hole therein and spaced from the frame aperture to define a gap therebetween;

a power cord;

a removable immobilizing rod passing through the frame aperture to physically couple the frame and the tub, comprising:

a spacer portion extending between the frame and the tub, and having an axially-disposed spacer bore;

a threaded fastener extending through the frame aperture, the spacer bore, and into the screw hole to immovably couple the tub with the frame; and a projection extending from the spacer portion to define a recess located within the gap for restraining the power cord within the gap in the interior of the frame;

wherein when the immobilizing rod couples the tub to the frame and the cord is received within the recess, the projection and cord are located within the gap in the interior of the frame rendering the cord inaccessible from the exterior of the frame for plugging into an outlet.

2. The washing machine of claim 1, wherein the projection is elastic.

3. The washing machine of claim 2, wherein the projection is hook shaped.

4. The washing machine of claim 1, further including a second immobilizing rod interposed between the tub and the frame and including a projection for restraining the power cord.

5. The washing machine of claim 1, wherein the portion of the frame cooperating with the immobilizing rod is a cross beam element having a shaped slot for allowing the fixing of a head of the threaded fastener and the removal of the immobilizing rod once the threaded fastener is unscrewed from the screw hole.

6. The washing machine of claim 1, wherein the portion of the frame cooperating with the immobilizing rod is a rear panel having a shaped slot for allowing the fixing of the head of the threaded fastener and the removal of the immobilizing rod once the threaded fastener is unscrewed from the screw hole.

* * * * *